United States Patent [19]

Tada et al.

[11] 4,218,668

[45] Aug. 19, 1980

[54] SUPERCONDUCTIVE MAGNET DEVICE

[75] Inventors: Naofumi Tada; Katsuzo Aihara, both of Hitachi, Japan

[73] Assignee: Hitachi, Ltd., Japan

[21] Appl. No.: 882,042

[22] Filed: Feb. 28, 1978

[30] Foreign Application Priority Data

Mar. 1, 1977 [JP] Japan ..... 52/22335
Jun. 10, 1977 [JP] Japan ..... 52/67922

[51] Int. Cl.[2] ..... H01F 7/22
[52] U.S. Cl. ..... 335/216
[58] Field of Search ..... 335/216

[56] References Cited

U.S. PATENT DOCUMENTS 3,406,362 10/1968 Revolinsky et al. ..... 335/216
3,913,044 10/1975 Albrecht et al. ..... 335/216

*Primary Examiner*—Fred L. Braun
*Attorney, Agent, or Firm*—Craig & Antonelli

[57] ABSTRACT

A superconductive magnet device comprising a coil assembly having a plurality of coil sections stacked along a center axis of the coil assembly, each of the coil sections being formed by winding a composite superconductive wire, which exhibits different superconductivities in one direction to another direction perpendicular to the one direction in a cross section of the wire, in layers in a direction perpendicular to the center axis, wherein the critical current density in a direction parallel to the center axis in the innermost layer of at least a central one of the coil sections is larger than the critical current density in a circumferential direction of the coil assembly. The present superconductive magnet device can withstand quenching of the superconductive state at a higher magnetic field than conventional ones.

18 Claims, 6 Drawing Figures

SUPERCONDUCTIVE MAGNET DEVICE

BACKGROUND OF THE INVENTION

1. Field of the Invention

The present invention relates to a superconductive magnet device, and more particularly to a superconductive magnet device having an intermetallic compound superconductive coil.

2. Description of the Prior Art

A superconductive magnet device has a coil assembly of a superconductive wire which can be essentially made of a superconductive material. However, a composite superconductive wire which is made of a superconductive material around which highly conductive metal such as copper, aluminum or silver is coated is usually used in preparation for the case of quenching of a superconductive state.

The superconductive material may comprise an alloy such as niobium-titanium alloy or niobium-titanium-zirconium alloy, or it may comprise intermetallic compounds such as $Nb_3Sn$, or $V_3Ga$. The intermetallic compound can show higher critical temperature and higher critical magnetic field. Accordingly, the use of the intermetallic compound has been noted rather than the alloy.

The composite superconductive wire comprising the intermetallic compound, for example $Nb_3Sn$, is manufactured by inserting a niobium wire into a tube of copper-tin alloy, reducing a cross-sectional area of the assembly by drawing or extruding, and heat-treating the assembly to form niobium-tin intermetallic compound $Nb_3Sn$ at an interface of the niobium wire and the copper-tin alloy tube.

The superconductive wire is wound to form a coil which is assembled in the magnet device. In order to facilitate the winding of the superconductive wire on a coil bobbin or a jig and to increase a space ratio of the superconductive wire, the superconductive wire usually has a rectangular cross-section, and it is wound on the coil bobbin with a longer edge side of the rectangle being in parallel to a center axis of the coil, that is, the longer edge side being in parallel to the direction of magnetic field. This winding method is hereinafter referred to as a flatwise winding method. Alternatively, such a winding method wherein the shorter edge side of the rectangle is in parallel to the center axis of the coil is referred to as an edgewise winding method. The coil bobbin or jig may sometimes be removed when the coil is assembled in the superconductive magnet device.

The superconductive wire is wound about a center axis of the resultant coil assembly in layers in the direction perpendicular to the center axis to form a coil section. A plurality of the thus wound coil sections are stacked in the direction of the central axis to form the coil assembly. The adjacent layers of each coil section are usually insulated from each other by insulators and the respective spaces between adjacent ones of the coil sections usually define flow paths for liquid helium.

The composite superconductive wire having the rectangular cross-section usually exhibits different superconductivity in one direction in the cross-section and a direction perpendicular thereto, although it is greatly influenced by a manufacturing process. Accordingly, the superconductivity differs depending on a particular winding method of the composite superconductive wire. For example, when the superconductive wire is wound flatwise, it frequently occurs that the critical current density in a direction parallel to the magnetic field is smaller than the critical current density in a direction perpendicular to the magnetic field. In this case, the quenching of superconductive state breakdown is apt to occur near the innermost layer of the central coil section where the magnetic field strength is the highest. It is considered that such a phenomenon is caused by the manufacturing process of the composite superconductive wire having a rectangular cross-section because it is manufactured from a wire having a substantially circular cross-section. In the process of forming the rectangular cross-section wire from the circular cross-section wire, the superconductive material is deformed and finally it loses the circular cross-section. As a result, it is considered that anisotropy occurs between the longer edge direction and the shorter edge direction of the rectangular cross-section for the pinning mechanism and the pinning force of the line of magnetic induction in the superconductive wire. Although the anisotropy of the superconductivity of the composite superconductive wire is not limited to the rectangular cross-section wire, it is apparent that the anisotropy appears in the rectangular cross-section wire, and it is also apparent that the anisotropy appears more clearly in the wire having a higher ratio of the longer edge to the shorter edge of the rectangle, that is, in the wire having higher aspect ratio.

Thus, because of the anisotropy of the superconductivity of the composite superconductive wire having the rectangular cross-section, which anisotropy is imparted by the manufacturing process, the superconductive magnet device having the coil formed by winding such a wire could not be designed to have a sufficiently high current density in view of a risk of quenching of the superconductive state. Particularly in the superconductive magnet device having a compound superconductive coil, a high critical current characteristic of the compound superconductive material could not be effectively utilized because of significant affect by the anisotropy of the superconductivity of the superconductive wire.

SUMMARY OF THE INVENTION

It is an object of the present invention to provide a superconductive magnet device which shows a retarded quenching of the superconductive state.

It is another object of the present invention to provide a superconductive magnet device which comprises a composite superconductive wire having anisotropy of superconductivity and which shows a more retarded quenching of the superconductive state than a conventional magnet device does.

It is another object of the present invention to provide a superconductive magnet device which comprises an intermetallic compound superconductive coil having a rectangular cross-section and which is higher in density of the current flowing through the coil than a conventional magnet device.

It is a further object of the present invention to provide a superconductive magnet device which is suited to exhibit a property of high critical current density which is inherent to an intermetallic compound superconductive material.

According to the present invention, there is provided a superconductive magnet device comprising a coil assembly formed having a plurality of coil sections stacked along a center axis of the coil assembly, each of the coil sections being formed by winding a composite superconductive wire, which exhibits different superconductivities in one direction to another direction perpendicular to the one direction in a cross-section of the wire, in layers in a direction perpendicular to the center axis, wherein the critical current density in a direction parallel to the center axis in the innermost layer of at least a central one of the coil sections is larger than the critical current density in a circumferential direction of the coil assembly.

The portion at which the critical current density in the direction parallel to the center axis of the coil is higher than the critical current density in the circumferential direction of the coil may extend throughout the innermost coil layers of the respective coil sections. Further, the entire coil assembly may be constructed to meet the above requirement. When such a portion is to be located only near the innermost layer/layers of at least one or two central coil section/sections (the minimum number of such central coil section/sections is one when there are an odd number of coil sections and two when there are even number of coil sections), it is preferable that the portion occupies at least one quarter of the length of the center axis of the coil, more preferably about one third, and still more preferably about one half. While the quenching of the superconductive state would normally be apt to occur near the innermost layer of the central coil section, the quenching of the superconductive state occurs rarely when the coil assembly is constructed in the manner described above. Furthermore, the magnetic field strength at which the quenching of the superconductive state occurs can be increased compared with the conventional device.

DETAILED DESCRIPTION OF THE PREFERRED EMBODIMENTS

Figure 1:
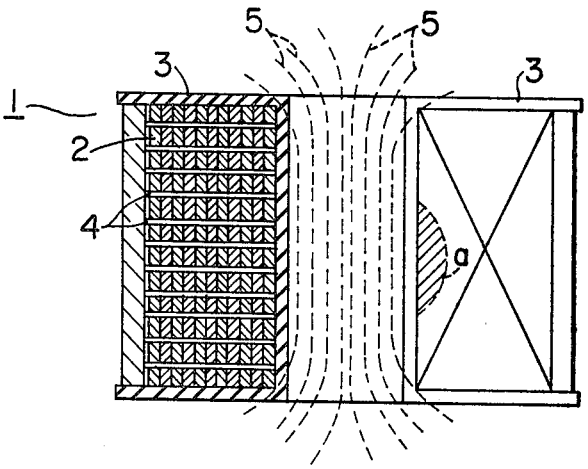
FIG. 1 shows a cross-sectional view for explaining the construction and function of a super-conductive magnet device.

FIG. 1 shows a cross-sectional view of a superconductive magnet device. A superconductive coil assembly 1 comprises a composite superconductive wire 2 having a rectangular cross-section and wound flatwise on a coil bobbin 3. The composite superconductive wire 2 is wound about a center axis of the coil assembly in layers in the perpendicular direction to the center axis to form a coil section and a plurality of the thus formed coil sections are stacked along the center axis to form the coil assembly. Numeral 4 denotes paths for a liquid cooling medium. Liquid helium is usually contained therein. Dotted lines 5 show lines of magnetic induction. Insulation (not shown) is provided at each boundary of adjacent layers of each of the coil sections of the composite superconductive wire. In the superconductive magnet device of the construction illustrated, the composite superconductive coil assembly is apt to be subjected to the quenching of the superconductive state at a high magnetic field region, that is, an area a near the innermost coil layer of the central coil section.

Figure 2:
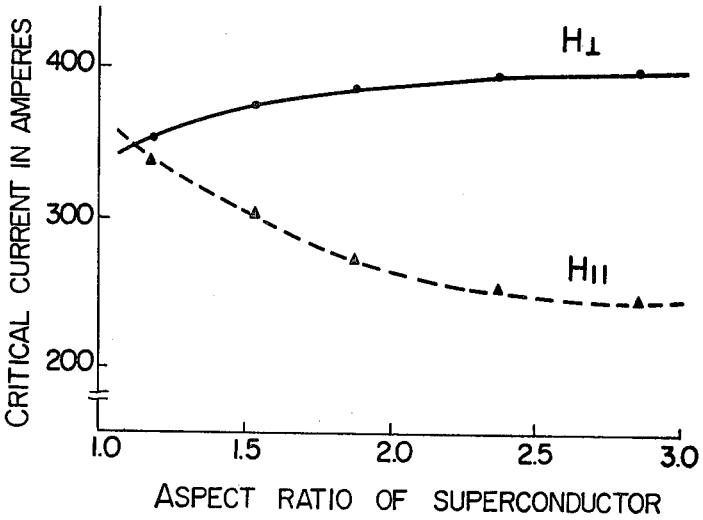
FIG. 2 shows a diagram illustrating a relationship between an aspect ratio of a composite super-conductive wire having a rectangular cross-section and a critical current.

FIG. 2 shows a diagram illustrating a relation between an aspect ratio of a compound superconductive wire having a rectangular cross-section and a critical current, in which an ordinate represents the critical current in amperes (A) and an abscissa represents the aspect ratio of the compound superconductive wire. The compound superconductive wire having a rectangular cross-section used in the experiment was manufactured by embedding 3240 niobium wires each having a diameter of approximately 10 microns in a matrix of copper alloy which includes 10% by weight of tin and forming the matrix to have a rectangular cross-section. The ratio of the sectional area of the matrix to the total sectional area of the niobium wires was approximately 1.5. The composite material was then heat-treated at 700° C. for 100 hours to form a $Nb_3Sn$ layer having a thickness of approximately 1 micron at the boundary of the copper alloy matrix and each niobium wire. Five different intermetallic compound superconductive wires having different aspect ratios of the rectangular cross-section formed in the manner described above were dipped in liquid helium at 4.2° K. and transverse magnetic field was applied thereto. Magnetic field-critical current characteristics were measured under a condition where an angle between the magnetic field and a longer edge side of the superconductive wire is right angles (condition $H_{|}$) and under a condition where the magnetic field is in parallel to the longer edge side (condition $H_{||}$).

The magnitude of the critical current under the condition $H_{|}$ when the magnetic field strength is 70 kiloersted increases as the aspect ratio increases while, under the condition $H_{||}$, it decreases as the aspect ratio increases. The change saturates at the aspect ratio of approximately 2.5.

Figure 3:
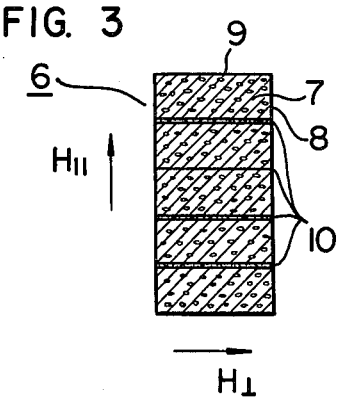
FIG. 3 shows a cross-sectional view of a composite superconductive wire in accordance with one embodiment of the present invention.

FIG. 3 shows a sectional view of a stacked composite superconductive wire 6 in accordance with one embodiment of the present invention, the wire 6 being formed of a plurality of electrically connected segment wires 7 as discussed below. In particular, five intermetallic compound composite superconductive wires 7 each having the same composition as that used in the above experiment but each having a smaller dimension were stacked such that a total length of the shorter edges 8 of the respective wires 7 was longer than a length of the longer edge 9 of each wire 7 and the stacked sides of adjacent wires 7 were joined by lead-tin alloy solder 10 to thereby form the stacked intermetallic compound superconductive wire 6. Five different, stacked composite superconductive wires 6 each having the above construction were prepared and they were dipped in the liquid helium at 4.2° K. as in the case of FIG. 2.

Figure 4:
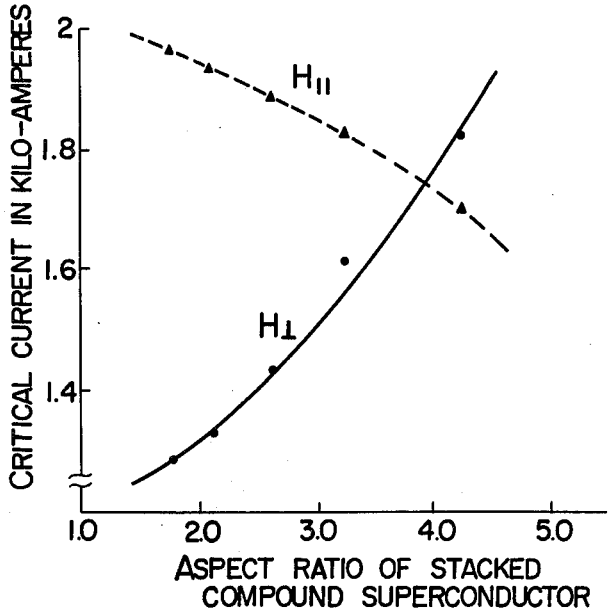
FIG. 4 shows a diagram illustrating a relation between an aspect ratio of a composite superconductive wire and a critical current.

FIG. 4 shows a diagram illustrating a relation between the aspect ratio and the critical current for the stacked composite superconductive wire 6 shown in FIG. 3. When the angle between the longer edge side of the stacked wire 6 which is composed of shorter edges 8 of the respective wires 7 and the magnetic field is at right angles (condition $H_{|}$), the critical current increases as the aspect ratio increases, and when the longer edge side of the stacked wire 6 is in parallel to the magnetic field (condition $H_{||}$), the critical current decreases as the aspect ratio increases. When the aspect ratio decreases below 4, the critical current under the condition $H_{81}$ is larger than that under the condition $H_{|}$.

The above relation is quite opposite to the relation shown in FIG. 2. Accordingly, when the stacked composite superconductive wire 6 is wound flatwise with the longer edge side 9 shown in FIG. 3 being in parallel to the center axis of the coil, it is possible to pass a high current therethrough and hence a high magnetic field strength is obtained.

Figure 5A:
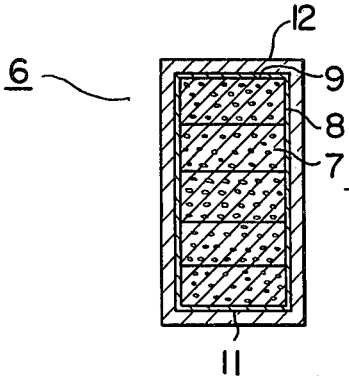
FIG. 5A shows a sectional view of the composite superconductive wire of the present invention before it is subjected to plastic working.
Figure 5B:
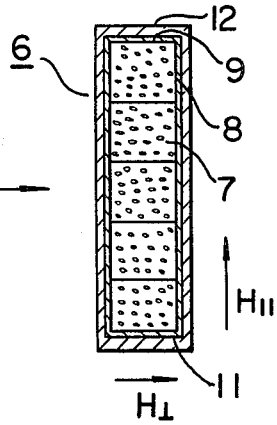
FIG. 5B shows a sectional view after plastic working.

Each of FIGS. 5A and 5B show a sectional view of a stacked composite superconductive wire 6 in accordance with another embodiment of the present invention. FIG. 5A shows a cross-section before plastic working while FIG. 5B shows a cross-section after plastic working. In FIG. 5A, five intermetallic compound composite superconductive wires 7 each having a rectangular cross-section were stacked such that a total length of the shorter edges 8 of the respective wires 7 was longer than a length of the longer edge 9 of each wire 7, and an outer surface of the stack was covered with a niobium foil 11, and a copper layer 12 was coated thereon. The assembly was then subjected to plastic working by applying a pressure in a direction to shorten the length of the longer edge 9 of each wire 7 of the stacked compound composite superconductive wire 6 and to expand the length of the shorter edge 8 of each wire 7 to form the structure as shown in FIG. 5B. The structure was thereafter heat-treated at 700° C. for 100 hours to form a $Nb_3Sn$ layer of the thickness of approximately 1 micron on the surface of each niobium wire.

The anisotropy of the critical current for the stacked superconductive wire shown in FIG. 5B was measured under the same conditions as those in FIGS. 2 and 4. Like in the case of FIG. 4, when the angle between the longer edge side of the stacked wire 6 which is composed of the stacked shorter sides 8 of the respective wires 7 and the magnetic field is a right angle (condition $H_{|}$), the critical current increases as the aspect ratio of the stacked superconductive wire increases, and when the longer edge side is in parallel to the magnetic field (condition $H_{||}$), the critical current decreases as the aspect ratio increases. The magnitude of the critical current is larger under the condition $H_{||}$ than under the condition $H_{|}$ when the aspect ratio after the plastic working is less than 4–5.

The table below shows a comparison of the characteristics of the superconductive coils of the superconductive magnet device having the stacked composite superconductive wire of the embodiment of the present invention wound thereon and a conventional superconductive magnet device.

The conventional magnet device has a coil of a compound superconductive wire having a rectangular cross-section of 6 mm in longer edge and 2 mm in shorter edge (aspect ratio of 3). 45790 niobium wires each having a diameter of 5 microns are embedded in the superconductive wire and a $Nb_3Sn$ layer having a thickness of approximately 1 micron is formed on the surface of each niobium wire.

In the table, sample No. 1 was manufactured by winding a compound superconductive wire having the rectangular cross-section flatwise as shown in FIG. 1, and sample No. 2 was manufactured by winding the wire such that the longer edge thereof is perpendicular to the center axis of the coil, that is, edgewise.

Samples No. 3 and No. 4 were manufactured in accordance with the embodiment of the present invention, as shown in FIG. 3. In these cases, five composite superconductive wires each having a rectangular cross-section of 2 mm in longer edge and 1.2 mm in shorter edge were stacked on each of the longer edge sides so that the total length of the shorter edges was equal to 6 mm (aspect ratio of 3) and the stacked five composite superconductive wires were wound flatwise without soldering the stacked surfaces of the wires and after the stacked surfaces were soldered, respectively. The same number of niobium wires as in the case of the conventional device were buried in the stacked composite superconductive wire. The sample No. 3 was not soldered at adjacent stacked surfaces of the wire while the sample No. 4 was soldered with lead-tin alloy.

Samples No. 5 and No. 6 were manufactured using the stacked composite superconductive wire in accordance with the other embodiment of the present invention shown in FIGS. 5A and 5B. Five composite superconductive wires each having a rectangular cross-section of 3 mm in longer edge and 1.0 mm in shorter edge were stacked, and an outer surface of the stack was coated with copper or stainless steel. The stack was then subjected to plastic working and wound flatwise.

The height of the superconductive coil would flatwise on the coil bobbin was 300 mm in each sample, and the length of the superconductive wire was 1 kilometer.

Those samples were excited at liquid helium temperature, and quenching currents and magnetic flux densities at the center of the coil were measured.

Table

| Sample No. | Superconductor: Manufacturing method | Superconductor: Specification (mm) | winding method | Aspect ratio | Coil dimension in mm I.D. × O.D. height | Coil current in Amperes | Magnetic flux density at center of coil in tesla |
|---|---|---|---|---|---|---|---|
| 1 | Conventional method | Rectangular cross-section of 6.0 in longer edge and 2.0 in shorter edge | flatwise | 3 | 180 × 450<br>300 | 936 | 5.5 |
| 2 | | | edgewise | | 540 × 680<br>300 | 1610 | 3.3 |
| 3 | | Five superconductive wires of 2.0 in longer edge and 1.2 in | | | | 1140 | 6.7 |

Table-continued

| Sample No. | Superconductor Manufacturing method | Superconductor Specification (mm) | winding method | Aspect ratio | Coil dimension in mm I.D. × O.D. height | Coil current in Amperes | Magnetic flux density at center of coil in tesla |
|---|---|---|---|---|---|---|---|
| | Present invention | shorter edge were stacked | flatwise | | 180 × 450<br>300 | | |
| 4 | | Five super-conductive wires of 2.0 in longer edge and 1:2 in shorter edge were stacked Soldered at the boundaries | | | | 1100 | 6.5 |
| 5 | | Five super-conductive wires of 3.0 in longer edge and 1.0 in shorter edge were stacked, and copper was coated thereover | | | | 1020 | 6.7 |
| | | | | 4.8 | 145 × 435<br>300 | | |
| 6 | | Five super-conductive wires of 3.0 in longer edge and 1.0 in shorter edge were stacked, and stain-less steel was coated thereover | | | | 1000 | 6.5 |

*I.D. = Inner Diameter
O.D. = Outer Diameter

The coils No. 1 and No. 2 manufactured by the conventional method show the magnetic flux density of equal to or less than 5.5 teslas at the center of the coil, while the coils in accordance with the present invention show the magnetic flux density of equal to or more than 6 teslas. This is because a larger current can press under the condition H || than under H| for a given dimension of the super-conductive wire and the coil formed by winding the stacked composite superconductive wire having a large aspect ratio allows a smaller inner diameter of the coil so that a higher H || is assured. Although the coils No. 5 and No. 6 which use the stacked composite superconductive wires coated with copper and stainless steel respectively did not fully show the effect thereof in the illustrated experiment, it is expected that they would show full effect when the length of the superconductive wire is longer.

As described above, according to the embodiments of the present invention, the critical current at the highest magnetic field region near the center of the coil can be significantly increased while the coil is wound flatwise. Accordingly, a higher magnetic flux density is obtained for a given size of the coil. Furthermore, when the stacked super-conductive wire is used, the inner diameter of the coil can be reduced because the aspect ratio increases, so that a high magnetic field can be obtained with a smaller size coil. As a result, the amount of the superconductor required is reduced and hence the amount of liquid helium required to cool the coil is also reduced. This is a significant advantage from the economic standpoint.

While the $Nb_3Sn$ has been explained in the above embodiments, other intermetallic compounds may be used to manufacture a similar high performance superconductive magnet device because they have the same trend in the anisotropy of the critical current.

When the construction as shown in the above embodiments is adapted, the pinning force of the lines of magnetic force which creates the anisotropy is in parallel to the center axis of the coil even when the coil is wound flatwise in an easier manner than the edgewise winding, and hence the critical current at the area which encounters the highest magnetic field can be significantly increased. In other words, when the stacked superconductive wire is wound flatwise as shown in FIG. 3 or 4, the anisotropy of the pinning force of the lines of magnetic induction is quite opposite to that of the coil formed by winding a conventional single superconductive wire having a rectangular cross-section of the same dimension. Accordingly, the critical current of the flatwise wound coil increases for a given inner diameter of the coil.

It is preferable that the anisotropy of the critical current of each of the compound composite superconductive wires each having a rectangular cross-section before they are stacked is somewhat larger because such anisotropy assures large anisotropy of the stacked superconductive wire, although the aspect ratio which results in an extreme anisotropy should be avoided in view of the relation between the inner diameter of the coil and the line of magnetic induction at the end of the coil. Strictly speaking, the anisotropy of the pinning force of the line of magnetic induction depends to a greater extent on the flatness of a core wire and the process of crystal growth of the compound layer which is grown perpendicularly to the flat core wire than on the aspect ratio of the compound superconductive wire. However, it is difficult to determine the dependency quantatively, the above explanation was based on the aspect ratio for the sake of convenience.

The experiment has proved that the most preferable range of the aspect ratio of each of the composite superconductive wires having a rectangular cross-section to be stacked is between 1.1 and 2.5, inclusive. For a higher aspect ratio, the increase of the critical current in the direction perpendicular to the longer edge side is very small. The preferable range of the aspect ratio of the stacked composite superconductive wire is between 1.1 and 5.0, inclusive, although it may change depending on the critical current in the direction of the magnetic field and the inner diameter of the coil.

In a large size superconductive coil, it is important to take the following measures as the energy stored in the coil increases. That is, the protection for the coil in the case wherein a normal conduction state occurs at a portion of the coil, the reinforcement to support a strong electromagnetic force, the fixing to prevent the movement of the superconductive wire by the electromagnetic force and the prevention of the electric power loss by the combined current in the superconductive wire due to varying magnetic fields should be considered. As a countermeasure thereto, the use of a material other than superconductor is necessary. In the stacked composite superconductive wire according to the present invention, it is possible to insert layers of reinforcing members, normal conductive metal, low melting point metal or alloy and electrically insulative material between adjacent ones of the compound superconductive wires stacked and each having a rectangular cross-section. It is also possible to stack a plurality of compound superconductive wires each having a rectangular cross-section and coat the outer surface of the stack with different material. Accordingly, the present invention can provide a superconductive magnet device which is large in size and can produce a high magnetic field in view of structure as well as performance.

We claim:

1. A superconductive magnet device comprising a coil assembly having a plurality of coil sections stacked along a center axis of said coil assembly, each of said coil sections being formed by winding a composite superconductive wire, which exhibits different superconductivities in one direction to another direction perpendicular to said one direction in a cross section of said wire, in layers in a direction perpendicular to said center axis, wherein the innermost wire of at least a central one of said coil sections is made up of electrically connected segment wires each having a critical current density which is larger in the direction perpendicular to the center axis than in the direction parallel to the center axis and exhibits a critical current density which is large in the direction parallel to said center axis than in a circumferential direction of said coil assembly.

2. A superconductive magnet device according to claim 1, wherein the critical current density in the axial direction of the coil assembly in at least one quarter of the total length of the coil assembly is larger than the critical current density in the circumferential direction of the coil assembly.

3. A superconductive magnet device according to claim 1, wherein the critical current density in the direction parallel to said center axis in the innermost wire of each of said coil sections is larger than the critical current density in the circumferential direction of said coil assembly.

4. A superconductive magnet device according to claim 1, wherein said innermost wire of at least a central one of said coil sections is constructed by stacking a plurality of segment wires in the form of composite superconductive wires each of which has a rectangular cross-section and exhibits a larger critical current density in the direction parallel to said center axis than the critical current density in the circumferential direction of the coil assembly.

5. A superconductive magnet device according to claim 4, wherein adjacent edge faces of adjacent ones of said plurality of stacked superconductive wires are electrically connected to each other at the boundary thereof.

6. A superconductive magnet device according to claim 5, wherein the connection is effected by solder.

7. A superconductive magnet device according to claim 1, wherein an outer surface of said innermost wire made up of segment wires is covered with a coating layer of an electrically conductive material.

8. A superconductive magnet device according to claim 7, wherein said coating layer is a copper layer.

9. A superconductive magnet device according to claim 1, wherein said wire is covered with a stainless steel layer.

10. A superconductive magnetic device comprising a coil assembly composed of a plurality of coil sections superposed through an insulating material in layers along a center axis of said coil assembly, each of said coil sections being formed by winding a composite superconductor wire comprising a superconductor material embedded in a metal matrix, said wire having a rectangular cross-section in the direction parallel to the center axis, one edge of the cross-section in the direction parallel to the center axis being longer than the other, in which at least the innermost wire of at least a central one of said coil sections is composed of a plurality of stacked segment wires each having a critical current density which is larger in the direction perpendicular to the center axis than in the direction parallel to the center axis, said segment wires being stacked in the direction parallel to the center axis and electrically connected to adjacent ones through adjacent edge faces of said segment wires to form the rectangular cross-section, whereby said innermost wire exhibits a critical current density which is larger in the direction parallel to the center axis than in the direction perpendicular to the center axis.

11. A superconductive magnet device according to claim 10, wherein said central wire is an intermetallic-compound superconductor wire.

12. A superconductive magnet device according to claim 10, wherein one fourth of the innermost wires of intermediate coil sections are each composed of the segment wires as defined in claim 10, whereby said innermost wires exhibit a critical current density which is larger in the direction parallel to the center axis than in the direction perpendicular to the center axis.

13. A superconductive magnet device according to claim 10, wherein one third of the innermost wires of the intermediate coil sections are each composed of the segment wires as defined in claim 10, whereby said innermost wires exhibit a critical current density which is larger in the direction parallel to the center axis than in the direction perpendicular to the center axis.

14. A superconductive magnet device according to claim 10, 11, 12 or 13, wherein said segment wires are soldered to electrically connect to each other.

15. A superconductive magnet device according to claim 10, 11, 12, or 13, wherein said innermost wire is covered with a layer of an electro-conductive metal material.

16. A superconductive magnet device according to claim 10, 11, 12, or 13, wherein said innermost wire is covered with a layer of stainless steel.

17. A superconductive magnet device according to claim 10, 11, 12 or 13, wherein said innermost wire is formed by soldering a plurality of segment wires each having the same rectangular cross-section one edge of which is longer than the other in the direction parallel to the center axis and having a current density which is larger in the direction perpendicular to the magnetic field than in the direction parallel to the magnetic field, covering the soldered segment wires with a layer of copper, subjecting the covered segment wires to plastic-working; and heat-treating the worked segment wires to form an intermetallic compound therein.

18. A superconductive magnet device according to claim 10, 11, 12, or 13, wherein the aspect ratio of said innermost wire is between 1.1 and 5.0.

* * * * *